US009425562B2

(12) United States Patent
Blazek et al.

(10) Patent No.: US 9,425,562 B2
(45) Date of Patent: Aug. 23, 2016

(54) CABLE CONNECTOR HAVING A SHIELDING INSERT

(71) Applicant: Tyco Electronics Corporation, Berwyn, PA (US)

(72) Inventors: Troy L. Blazek, Cottage Grove, MN (US); Matthew Ryan Schmitt, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 240 days.

(21) Appl. No.: 14/223,299

(22) Filed: Mar. 24, 2014

(65) Prior Publication Data

US 2015/0270649 A1 Sep. 24, 2015

(51) Int. Cl.
*H01R 13/6599* (2011.01)
*H01R 13/6597* (2011.01)
*H01R 13/6592* (2011.01)

(52) U.S. Cl.
CPC ..... *H01R 13/6599* (2013.01); *H01R 13/6592* (2013.01); *H01R 13/6597* (2013.01)

(58) Field of Classification Search
CPC ..... H01R 13/6599
See application file for complete search history.

(56) References Cited

U.S. PATENT DOCUMENTS

| | | | | | |
|---|---|---|---|---|---|
| 4,272,148 | A * | 6/1981 | Knack, Jr. | H01R 9/032 | 439/455 |
| 4,929,195 | A * | 5/1990 | Seidoh | H01R 13/6599 | 439/465 |
| 5,009,614 | A * | 4/1991 | Fogg | H01R 13/6585 | 439/497 |
| 5,074,808 | A * | 12/1991 | Beamenderfer | H01R 9/034 | 29/855 |
| 5,364,292 | A * | 11/1994 | Bethurum | H01R 13/6599 | 439/607.02 |
| 5,562,497 | A * | 10/1996 | Yagi | H01R 13/516 | 439/607.47 |
| 5,955,703 | A * | 9/1999 | Daly | H01R 13/6658 | 174/117 R |
| 6,482,017 | B1 * | 11/2002 | Van Doorn | H01R 13/5213 | 439/149 |
| 6,857,899 | B2 * | 2/2005 | Reed | H01R 23/662 | 439/497 |
| 2014/0154928 | A1 * | 6/2014 | Nonen | H01R 4/04 | 439/660 |
| 2015/0044909 | A1 * | 2/2015 | Dunwoody | H01R 13/6593 | 439/607.56 |

* cited by examiner

*Primary Examiner* — James Harvey

(57) ABSTRACT

In one embodiment, an electrical connector is disclosed. The electrical connector comprises a shell having a mating end and a cable end. The shell has a cavity with at least one conductor therein. The at least one conductor is arranged at the mating end for termination to a mating connector. The shell has a cable extending from the cavity through the cable end being electrically connected to the at least one conductor. The electrical connector also includes a shielding insert received proximate to the cable end. The shielding insert circumferentially surrounds the cable and is configured to block transmission of electromagnetic radiation through the cable end.

20 Claims, 4 Drawing Sheets

CABLE CONNECTOR HAVING A SHIELDING INSERT

BACKGROUND OF THE INVENTION

The subject matter herein relates generally to cable connectors.

Various types of fiber optic and copper based connectors that permit communication, such as between host equipment and external devices, are known. These connectors can be pluggably connected to other connectors to provide flexibility in system configuration. These connectors are generally constructed to established standards for size and compatibility. For example, the connector may conform to a Small Formfactor Pluggable (SFP), a derivative thereof, or similar standard, such as, SFP+, XFP, CFP, GBIC, QSFP, XENPAK, PON, X2. These various standards have data transmission requirements. For example, the XFP and QSFP standards require that the electronic connectors be capable of transmitting data at high rates, such as 10 Gbps (Gigabits per second). As the signal transmission rates increase, the circuitry and/or the wiring within the connector generates larger amounts of electromagnetic radiation at shorter wavelengths and higher energy. The high-energy electromagnetic radiation increases the likelihood that electromagnetic radiation may escape through openings in the connector. For example, the connector may include an opening at one end to allow a cable to pass therethrough. Electromagnetic radiation may escape through such an opening. Adjacent connectors, and/or other foreign electrical components outside of the electrical connector, such as the host equipment and the external devices, may experience interference as a result of the electromagnetic radiation. This electromagnetic interference (EMI) can degrade the quality and/or performance of the electrical components or the connector.

A need remains for a cable connector having reduced leakage of electromagnetic radiation.

BRIEF DESCRIPTION OF THE INVENTION

In one embodiment, an electrical connector is disclosed. The electrical connector comprises a shell having a mating end and a cable end. The shell has a cavity with at least one conductor therein. The at least one conductor is arranged at the mating end for termination to a mating connector. The shell has a cable extending from the cavity through the cable end being electrically connected to the at least one conductor. The electrical connector also includes a shielding insert received proximate to the cable end. The shielding insert circumferentially surrounds the cable and is configured to block transmission of electromagnetic radiation through the cable end.

In one embodiment, an electrical connector is disclosed. The electrical connector comprises a shell having a mating end and a cable end. The shell has a cavity with at least one conductor therein. The at least one conductor is arranged at the mating end for termination to a mating connector. The shell has a cable extending from the cavity through the cable end being electrically connected to the at least one conductor. The shell defines a pocket in the cavity proximate to the cable end with the cable passing through the pocket. The electrical connector also includes a shielding insert received in the pocket. The shielding insert circumferentially surrounds the cable and is configured to block transmission of electromagnetic radiation through the cable end. The shielding insert includes a front segment and a rear segment. The front segment is formed from a first material. The rear segment is formed from a second material that is different than the first material. The first material has a higher electromagnetic radiation absorbing characteristic than the second material.

In one embodiment, an electrical connector is disclosed. The electrical connector comprises a shell having a mating end and a cable end. The shell has a cavity with at least one conductor therein. The at least one conductor is arranged at the mating end for termination to a mating connector. The shell has a cable extending from the cavity through the cable end being electrically connected to the at least one conductor. The shell defines a pocket in the cavity proximate to the cable end with the cable passing through the pocket. The electrical connector also includes a shielding insert received in the pocket. The shielding insert circumferentially surrounds the cable and is configured to block transmission of electromagnetic radiation through the cable end. The shielding insert includes a front segment and a rear segment. The front segment is formed from a first material. The rear segment is formed from a second material that is different than the first material. The first material is conductive and the second material is non-conductive.

DETAILED DESCRIPTION OF THE INVENTION

Figure 1:
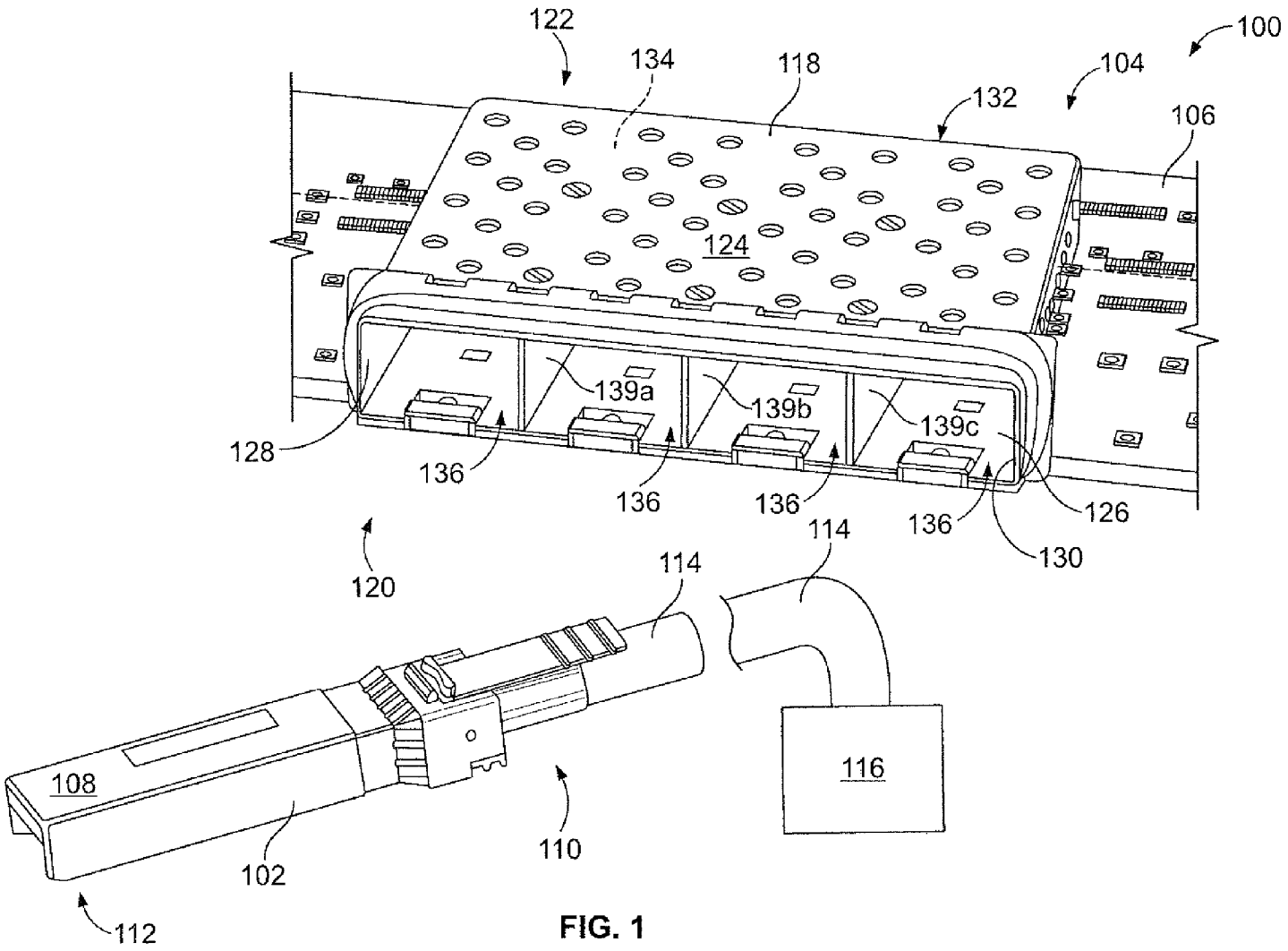
FIG. 1 is a perspective view of an electrical connector system in accordance with an embodiment.

FIG. 1 is a perspective view of an electrical connector system 100 in accordance with an embodiment. The electrical connector system 100 includes one or more connectors, such as a cable connector 102 that may be plugged into a receptacle assembly 104. The receptacle assembly 104 may be mounted on a circuit board 106 of a host device. The circuit board 106 may be any circuit board, such as, for example, a motherboard in the host device. For example, the host device may be any electrical device, such as but not limited to, a computer, router, network switch, hub, and/or the like.

The cable connector 102 includes a shell 108 having a cable end 110 opposite a mating end 112. A cable 114 is terminated to the cable connector 102 at the cable end 110. The cable 114 may be electrically connected to an electrical device 116. When the cable connector 102 is received within the receptacle assembly 104, the electrical connector system 100 connects the electrical device 116 to the circuit board 106 as discussed below. The cable connector 102 includes components to reduce interference caused by electromagnetic radiation.

The receptacle assembly 104 is illustrated as having four ports, although the invention may be used with a receptacle assembly having only a single port or any number of ports. The receptacle assembly 104 includes a guide frame 118 positioned on the circuit board 106 and configured to receive the cable connector 102. The guide frame 118 houses a plurality of receptacle connectors (not shown) positioned therein and configured to electrically connect the cable connector 102 to the circuit board 106. The guide frame 118 has a plug end portion 120 through which the cable connector 102 is installed. The plug end portion 120 is configured to be mounted or received within an opening of a panel (not shown) that is adjacent to the circuit board 106. For example, the panel may be a wall of a housing encapsulating the host device. In such an example, the cable connector 102 which is initially outside the housing can be received in the receptacle assembly 104 to be electrically connected to the circuit board 106 which is behind the panel and contained within the host device.

The guide frame 118 extends between the plug end portion 120 and an opposite rear end portion 122. In the illustrated embodiment, the guide frame 118 has a generally rectangular cross section and includes an upper wall 124, a lower wall 126, side walls 128 and 130, and a rear wall 132. The guide frame 118 includes an internal chamber 134 that is subdivided into a plurality of internal bays or compartments 136. In the illustrated embodiment, the guide frame 118 includes divider walls 138*a*, 138*b*, and 138*c* that divide the internal camber into the compartments 136. Each of the compartments 136 are configured to receive and secure the mating end 112 of one of the cable connector 102 therein. Although the guide frame 118 is shown as including four compartments 136 arranged in a single row, the guide frame 118 may include any number of compartments 136, arranged in any number of rows and/or columns, for receiving any number of connectors.

Each of the compartments 136 includes a respective receptacle connector (not shown) housed therein. The receptacle connector is electrically connected to the circuit board 106. When the cable connector 102 is inserted into one of the compartments 136, the receptacle connector electrically connects the cable connector 102 to the circuit board 106. As discussed above, the cable connector 102 is terminated to the cable 114 that terminates to the electrical device 116. Accordingly, the electrical device 116 may be electrically coupled to the circuit board 106 of the host device via the cable connector 102.

Figure 2:
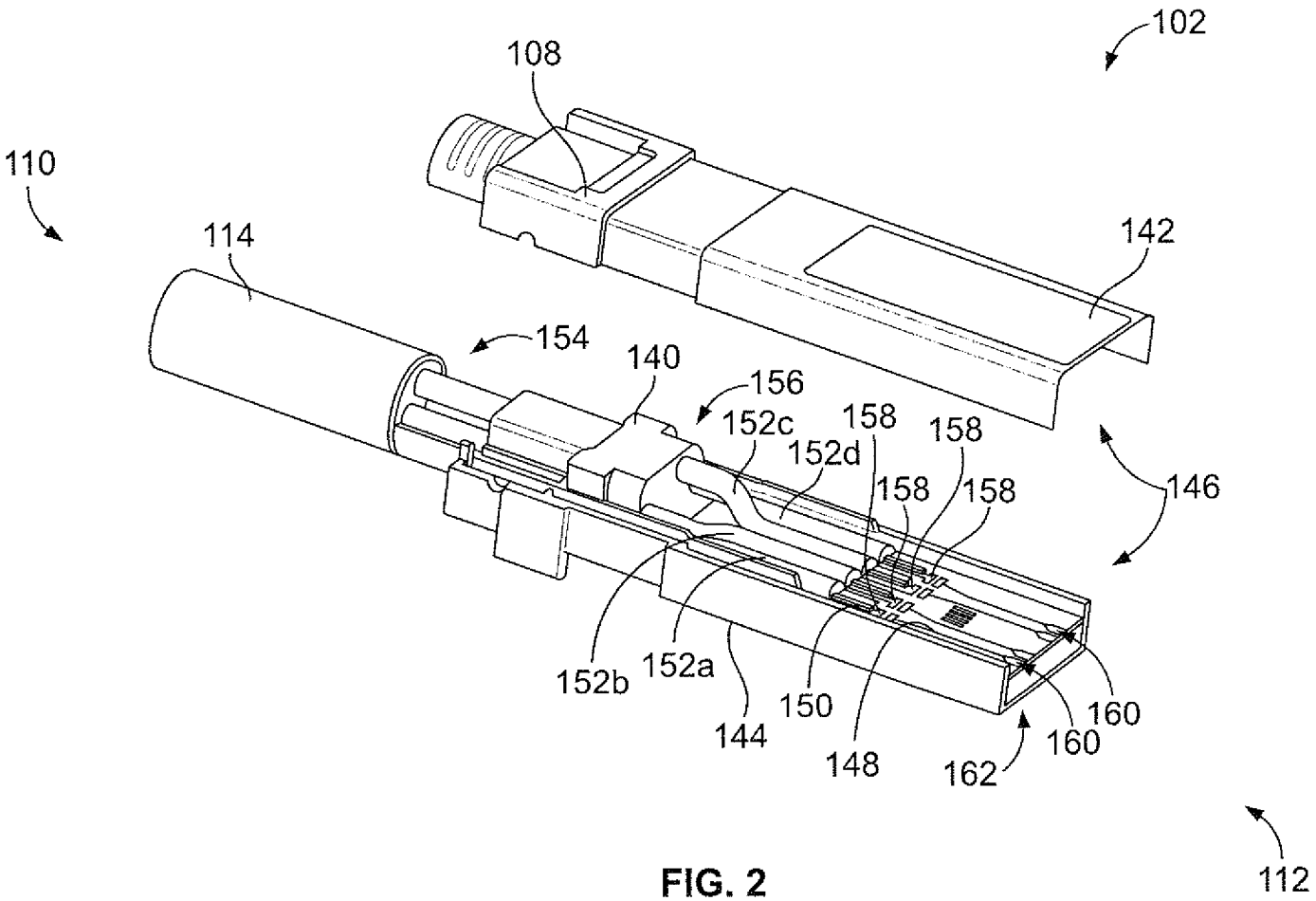
FIG. 2 is a partial exploded perspective view of a connector in accordance with an embodiment.

FIG. 2 is a partial exploded perspective view of the cable connector 102 in accordance with an embodiment. In the illustrated embodiment, the cable connector 102 includes the cable end 110 and the mating end 112. But other configurations are possible in various embodiments, for example, the cable connector 102 may include a second cable end. In the illustrated embodiment, the cable connector 102 is shown as a small form-factor pluggable (SFP) connector, however, the cable connector 102 may be any type of pluggable electrical component.

The cable connector 102 includes a shielding insert 140. The shielding insert 140 is configured to block transmission of electromagnetic radiation. The shielding insert 140 is situated proximate to the cable end 110. As discussed below, the shielding insert 140 circumferentially surrounds the cable 114. In this manner, the shielding insert substantially blocks or eliminates the transmission of electromagnetic radiation through the cable end 110.

The shell 108 has a top cover 142 and a base 144 that are secured together to form a cavity 146 therebetween. The cavity 146 may be selectively sized and shaped to house a connector circuit board 148, one or more conductors 150, and/or the cable 114, among other components. The top cover 142 and the base 144 may be made of any suitable material, such as, for example, a metal, a polymer, or other suitable material. The top cover 142 and the base 144 may be secured to one another using any means commonly known in the art for joining the housing pieces, such as, but not limited to, a snap fit, a friction fit, the use of a threaded fastener (for example, screws) and/or the like.

One or more of the conductors 150 define transmission lines extending through the cavity 146 between the cable end 110 and the mating end 112. The conductors 150 may be any type of electrical conductor configured to be connected to a mating component, such as the receptacle connector housed within the guide frame 118 (shown in FIG. 1). The conductors 150 may be terminated to the circuit board 148 on a proximal end, and may be terminated to wires 152 within the cable 114 on a distal end. The wires 152 may comprise at least a portion of the conductors 150. For example, in the illustrated embodiment, the cable 114 includes wires 152*a*, 152*b*, 152*c*, and 152*d* housed therein. The wires 152 may extend beyond a terminal end 154 of the cable 114. The wires 152 may extend to and through the shielding insert 140 received in a pocket 156 (also shown in FIG. 3) in the cavity 146, as is described below. In various embodiments, the conductors 150 may include traces of the connector circuit board 148. Other types of conductors may form part of the transmission lines defining the conductors 150.

The connector circuit board 148 may be any circuit board, for example, the connector circuit board 148 may be a circuit board configured to perform transceiver functions. The wires 152 may terminate to wire contact pads 158 on the connector circuit board 148. The wire contact pads 158 may then electrically connect to contact pads 160 arranged along an edge portion 162 of the connector circuit board 148. For example, the connector circuit board 148 may include traces to electrically connect the wire contact pads 158 to the contact pads 160. The contact pads 160 may define the electrical interface of the cable connector 102. When the cable connector 102 is fully loaded into one of the compartments 136 (shown in FIG. 1), the contact pads 160 electrically connect with corresponding terminal contacts (not shown) within the electrical connector housed within the guide frame 118.

Figure 3:
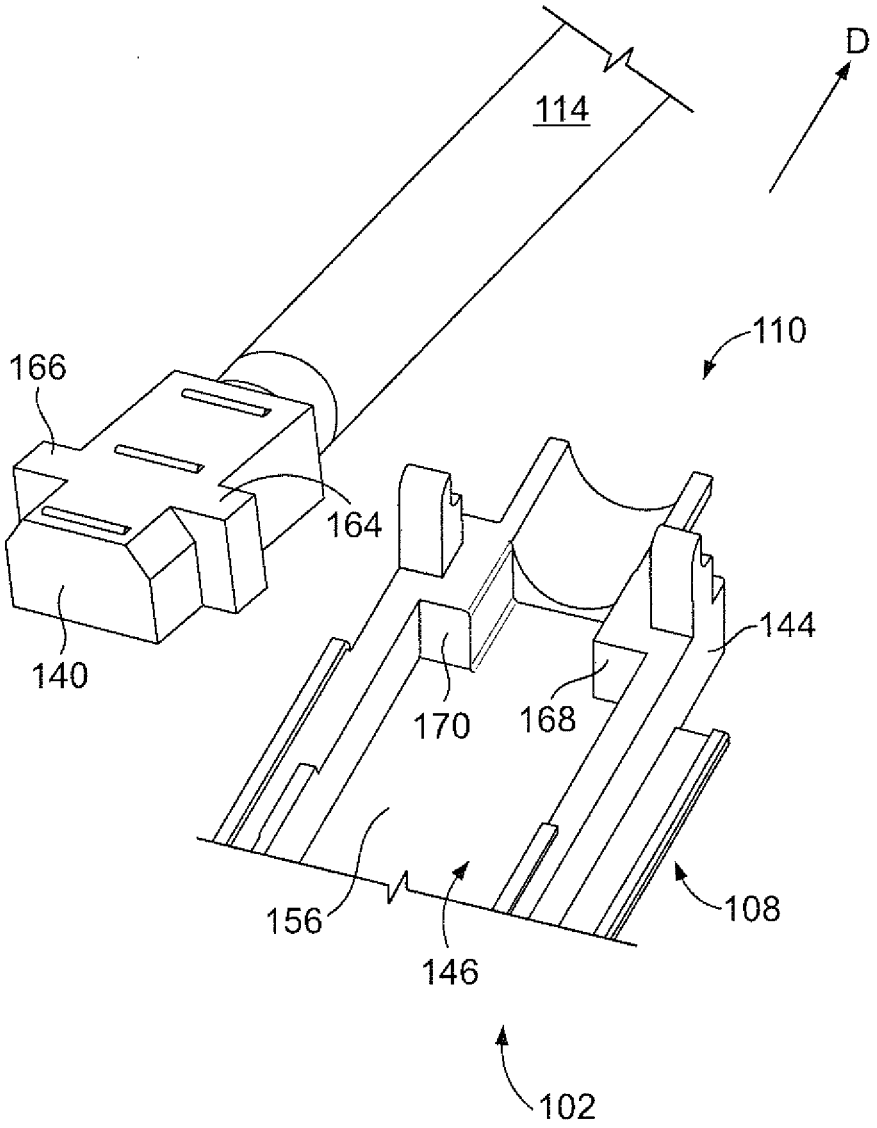
FIG. 3 is a perspective view of a portion of a connector showing a shielding insert outside of a pocket in accordance with an embodiment.

FIG. 3 is a perspective view of a portion of the cable connector 102 showing the shielding insert 140 outside of the pocket 156. In an exemplary embodiment, the shielding insert 140 is molded in place in the pocket 156 around the cable 114, and as such would remain positioned in the pocket 156 as opposed to being removable from the pocket 156. However, in alternate embodiments, the shielding insert 140 may be pre-formed and may be separately loaded into the pocket 156. The pocket 156 is a portion of the cavity 146 in the base 144 and/or the top cover 142 (shown in FIG. 2). The pocket 156 may be selectively sized and shaped to ensure that the shielding insert 140 remains in position in the base 144. The pocket 156 may be located proximate to the cable end 110. A portion of the cable 114 passes through the pocket 156 and the shielding insert 140.

In an exemplary embodiment, the shielding insert 140 circumferentially surrounds the cable 114 and/or the wires 152 (shown in FIG. 2) to restrict movement of the conductor 150 (shown in FIG. 2). The shielding insert 140 provides strain relief for the wires 152. By molding in place in the pocket 156 around the cable 114, the cable 114 is stabilized by the shielding insert 140. The shielding insert 140 restricts movement of the cable 114 and/or the conductors 150 within the pocket 156 to provide strain relief for the cable 114 and/or the wires 152. For example, the shielding insert 140 may limit movement of the cable 114 and/or the wires 152 in a longitudinal direction D. Additionally, the shielding insert 140 may limit the amount of transverse deflection of the cable 114 (for example, bending of the cable perpendicular to the direction D). Additionally, the shielding insert 140 may provide torsional strain relief by limiting rotational movement of the cable 114.

The shielding insert 140 conforms to the contours of the pocket 156 such that a relatively tight fit may be achieved in the base 144. The shielding insert 140 includes flanges 164 and 166 diametrically opposed along the body of the shielding insert 140. The flanges 164, 166 abut against stops 168, 170, respectively, in the pocket 156. For example, the flange 164 may abut against the stop 168 such the stop 168 limits movement of the shielding insert 140 in the direction D. Similarly, the flange 166 may abut against the stop 170 such that the stop 170 limits movement of the shielding insert 140 in the direction D. In the illustrated embodiment, the flanges 164, 166 are shown as being integrally formed with the shielding insert 140. However, in other embodiments, the flanges 164, 166 may be separate components that are secured to the shielding insert 140. Optionally the shielding insert 140 may be compressible between the top cover 142 and the base 144 to provide a seal between the top cover 142 and the base 144. No gaps exist between the top cover 142 and the base 144 at the cable end 110.

The shielding insert 140 provides electromagnetic shielding and the relatively tight fit of the shielding insert 140 in the shell 108 limits transmission of electromagnetic radiation through the cable end 110. The conductors 150 and/or wires 152 may transmit electrical signals at high frequencies and may emit electromagnetic radiation. For example, the connector circuit board 148 and/or the wires 152 may radiate electromagnetic radiation into the cavity 146 and the electromagnetic radiation may escape through openings or gaps at the cable end 110, the mating end 112, and/or seams (not sown) between the top cover 142 and the base 144 of the shell 108. The electromagnetic radiation may detrimentally interfere with signals carried in the cable 114, thus reducing the performance of the electrical cable connector 102. Additionally, the electromagnetic radiation may cause electromagnetic interference (EMI) and may disrupt or otherwise degrade the operation of other electrical devices and/or other electrical components in the vicinity of the cable connector 102. For example, the EMI may degrade the performance of the host device and/or the electrical device 116 (shown in FIG. 1). Embodiments of the shielding insert 140 substantially suppress, reduce, or eliminate the transmission of the electromagnetic radiation through the cable end 110. In another exemplary embodiment, the shielding insert 140 is manufactured from a material to absorb and/or reflect the electromagnetic radiation.

Figure 4:
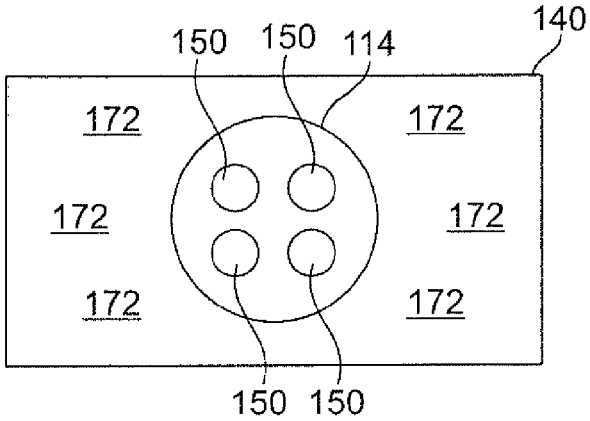
FIG. 4 is a cross sectional view of a shielding insert configured to absorb electromagnetic radiation in accordance with an embodiment.

FIG. 4 is a cross sectional view of the shielding insert 140 configured to absorb electromagnetic radiation in accordance with an embodiment. In the illustrated embodiment, the cable 114 is shown passing through the shielding insert 140, however, in other embodiments, such as the embodiment illustrated in FIG. 2, only the conductors 150 may pass through the shielding insert 140. In various embodiments, the shielding insert 140 is manufactured from electromagnetic radiation absorbing material 172 configured to absorb substantially all of the electromagnetic radiation before the electromagnetic radiation exits the cable end 110 (shown in FIG. 1) of the shell 108 (shown in FIG. 1). The electromagnetic radiation absorbing material 172 is a material configured to suppress the propagation of electromagnetic radiation or waves. For example, the shielding insert 140 may be manufactured from a material having high electromagnetic radiation absorbing characteristic, such as, for example, a low magnetic permeability factor or a low electric permittivity factor. In various embodiments, the composition and/or density of the shielding insert 140 may be based on the desired amount of electromagnetic radiation absorption.

Figure 5:
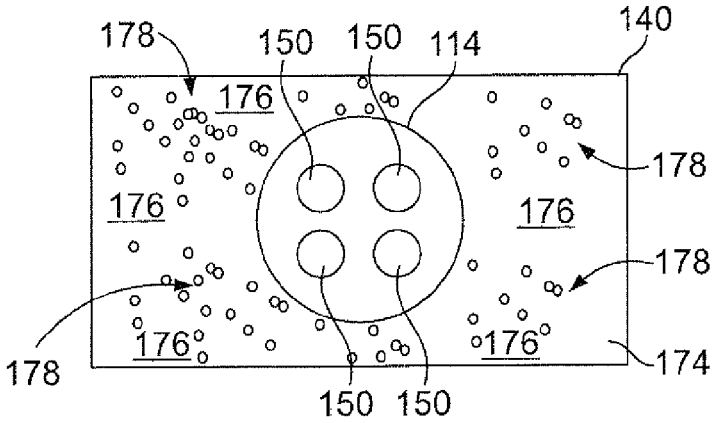
FIG. 5 is a cross sectional view of a shielding insert configured to reflect electromagnetic radiation in accordance with an embodiment.

FIG. 5 is a cross sectional view of the shielding insert 140 configured to reflect electromagnetic radiation in accordance with an embodiment. In the illustrated embodiment, the cable 114 and the conductors 150 are shown passing through the shielding insert 140. In various embodiments, the shielding insert 140 may be configured to reflect, trap, and/or guide the electromagnetic radiation into the shell 108 (shown in FIG. 1) to prevent the transmission of electromagnetic radiation through the cable end 110 (shown in FIG. 1). The shielding insert 140 is manufactured from a conductive impregnated dielectric material 174. The conductive impregnated dielectric material 174 dissipates substantially all of the electromagnetic radiation exiting the cable end 110 by reflecting (for example, scattering, diffusing, or guiding) the electromagnetic radiation into the shell. The conductive impregnated dielectric material 174 includes a dielectric base or substrate 176 and conductive particles or flakes 178 embedded throughout the dielectric substrate 176. For example, the conductive flakes 178 may comprise metal fibers or flakes, such as silver particles. The dielectric substrate 176 may be the electromagnetic radiation absorbing material 172 (shown in FIG. 4). Although shown having a nearly uniform random distribution in the illustrated embodiment, the conductive flakes 178 may be selectively distributed throughout the dielectric substrate 176. For example, the conductive flakes 178 may be in close, touching proximity such that conductive paths created through the shielding insert 140 allow the radiation to be transmitted into the shell 108. The conductive flakes 178 are electrically connected to the shell 108 to direct the electromagnetic radiation into the shell 108. The conductive impregnated dielectric material 174 is then electrically grounded to the shell 108.

Figure 6:
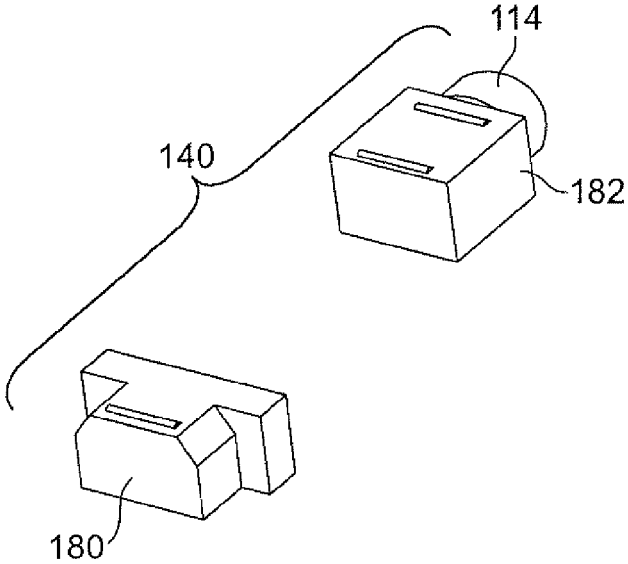
FIG. 6 is an exploded perspective view of a shielding insert in accordance with an embodiment.

FIG. 6 is an exploded perspective view of the shielding insert 140 in accordance with an embodiment. In an exemplary embodiment, the shielding insert 140 may be formed by joining a front segment 180 and a rear segment 182. The front and rear segments 180, 182 may be formed of different materials. For example, the front segment 180 may be formed of less expensive dielectric material while the rear segment 182 is formed of the electromagnetic radiation absorbing material 172 (shown in FIG. 4) or the conductive impregnated dielectric material 174 (shown in FIG. 5). The second material of the rear segment 182 has a higher electromagnetic radiation absorbing characteristic than the first material of the front segment 180.

The front and rear segments 180, 182 may be overmolded over the cable 114 and/or the conductors 150 (shown in FIG. 2) in a split-shot overmold as a multi-stage molding process. The first shot of the split-shot overmold is accomplished with a first material, while the second shot of the split-shot overmold is accomplished with a second material different than the first material. For example, the first shot of the split-shot overmold may be accomplished with the electromagnetic radiation absorbing material 172 or the conductive impregnated dielectric material 174. The second shot of the split-shot overmold may be a non-conductive (for example, electrically insulative) hot melt configured to provide strain relief and structural rigidity. The second shot may be a less expensive material than the first material. Enough of the first material is used in the first shot to provide the desired amount of radiation absorbing or dissipation and the remainder of the insert 140 is formed with the molding of the second material in the pocket 156. In an exemplary embodiment, the second shot is molded in situ against the first shot.

The first and the second shot of the overmold conform to the contours of the pocket 156 (shown in FIG. 2). The split-shot overmold reduces manufacturing costs by reducing the amount of electromagnetic radiation absorbing material 172 or the conductive impregnated dielectric material 174 required to form the shielding insert 140. The split-shot overmold also allows the electromagnetic radiation absorbing material 172 or the conductive impregnated dielectric material 174 to be situated near the cable end 110 and/or near the cable shield of the cable.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §102(f), unless and until such claim limitations expressly use the phrase "means for" followed by a statement of function void of further structure.

What is claimed is:

1. A cable connector comprising:

a shell having a mating end and a cable end, the shell having a cavity with at least one conductor therein arranged at the mating end for termination to a mating connector, the shell defining a pocket in the cavity proximate to the cable end, the shell having a cable extending from the cavity through the cable end, the cable passing through the pocket and being electrically connected to the at least one conductor; and a shielding insert proximate to the cable end, the shielding insert circumferentially surrounding the cable and configured to block transmission of electromagnetic radiation through the cable end, the shielding insert being molded in place in the pocket around the cable.

2. The cable connector of claim 1, wherein the shielding insert comprises an electromagnetic radiation absorbing material configured to absorb substantially all of the electromagnetic radiation before the electromagnetic radiation exits the cable end of the shell.

3. The cable connector of claim 1, wherein the shielding insert comprises a conductive impregnated dielectric material configured to dissipate substantially all of the electromagnetic radiation by reflecting transmission of the electromagnetic radiation into the shell.

4. The cable connector of claim 3, wherein the conductive impregnated dielectric material includes a dielectric element and conductive particles embedded throughout the dielectric element, the conductive particles being electrically connected to the shell to direct the electromagnetic radiation into the shell.

5. The cable connector of claim 1, wherein the shielding insert includes a body and two diametrically-opposed flanges that extend from the body, the flanges configured to abut against corresponding stops in the pocket to limit movement of the shielding insert within the pocket of the shell.

6. The cable connector of claim 1, wherein the shielding insert is further configured to restrict movement of the cable in within the pocket.

7. The cable connector of claim 1, wherein the shielding insert includes a front segment and a rear segment, the front segment being formed from a first material, the rear segment being formed from a second material different than the first material, the first material being non-conductive, the second material being conductive.

8. The cable connector of claim 1, wherein the shielding insert is a split-shot overmold over the cable, with a first shot of the split-shot overmold being with an electromagnetic radiation absorbing material and with a second shot of the split-shot overmold being with a non-electromagnetic radiation absorbing material.

9. The cable connector of claim 1, further comprising a circuit board in the cavity, the circuit board comprising the conductor, the cable being terminated to the circuit board.

10. The cable connector of claim 1, wherein the shielding insert includes a front segment and a rear segment, the front segment being formed from a first material, the rear segment being formed from a second material different than the first material, the second material having higher electromagnetic radiation absorbing characteristics than the first material.

11. A cable connector comprising:

a shell having a mating end and a cable end, the shell having a cavity with at least one conductor therein arranged at the mating end for termination to a mating connector, the shell having a cable extending from the cavity through the cable end, the cable being electrically connected to the at least one conductor, the shell defining a pocket in the cavity proximate to the cable end with the cable passing through the pocket;

a shielding insert received in the pocket, the shielding insert circumferentially surrounding the cable and configured to block transmission of electromagnetic radiation through the cable end; the shielding insert including a front segment and a rear segment, the front segment being formed from a first material, the rear segment being formed of a second material different than the first material; the first material having a higher electromagnetic radiation absorbing characteristic than the second material.

12. The cable connector of claim 11, wherein the shielding insert is a split-shot overmold over the cable, with a first shot of the split-shot overmold being with an electromagnetic radiation absorbing material and with a second shot of the split-shot overmold being with a non-electromagnetic radiation absorbing material.

13. The cable connector of claim 11, wherein the shielding insert comprises an electromagnetic radiation absorbing material configured to absorb substantially all of the electromagnetic radiation before the electromagnetic radiation exits the cable end of the shell.

14. The cable connector of claim 11, wherein the shielding insert is molded in place in the pocket around the cable.

15. The cable connector of claim 11, further comprising a circuit board in the cavity, the circuit board comprising the conductor, the cable being terminated to the circuit board.

16. A cable connector comprising:

a shell having a mating end and a cable end, the shell having a cavity with at least one conductor therein arranged at the mating end for termination to a mating connector, the shell having a cable extending from the cavity through the cable end, the cable being electrically connected to the at least one conductor, the shell defining a pocket in the cavity proximate to the cable end with the cable passing through the pocket;

a shielding insert received in the pocket, the shielding insert circumferentially surrounding the cable and configured to block transmission of electromagnetic radiation through the cable end; the shielding insert including a front segment and a rear segment, the front segment being formed from a first material, the rear segment being formed of a second material different than the first material; the first material being conductive, the second material being non-conductive.

17. The cable connector of claim 16, wherein the first material comprises a conductive impregnated dielectric material configured to dissipate substantially all of the electromagnetic radiation by reflecting transmission of the electromagnetic radiation into the shell.

18. The cable connector of claim 17, wherein the conductive impregnated dielectric material includes a dielectric element and conductive particles embedded throughout the dielectric element, the conductive particles being electrically connected to the shell to direct the electromagnetic radiation into the shell.

19. The cable connector of claim 16, wherein the shielding insert is molded in place in the pocket around the cable.

20. The cable connector of claim 16, further comprising a circuit board in the cavity, the circuit board comprising the conductor, the cable being terminated to the circuit board.

* * * * *